US008926060B2

(12) United States Patent
Moscato et al.

(10) Patent No.: US 8,926,060 B2
(45) Date of Patent: Jan. 6, 2015

(54) SYSTEM AND METHOD FOR CLEANING INKJET CARTRIDGES

(71) Applicants: Anthony V. Moscato, North Tonawanda, NY (US); Theodore F. Cyman, Jr., Grand Island, NY (US); Jeffrey M. Sabin, West Seneca, NY (US); John R. Soltysiak, Blasdeel, NY (US); Brett C. Rimes, Grand Island, NY (US)

(72) Inventors: Anthony V. Moscato, North Tonawanda, NY (US); Theodore F. Cyman, Jr., Grand Island, NY (US); Jeffrey M. Sabin, West Seneca, NY (US); John R. Soltysiak, Blasdeel, NY (US); Brett C. Rimes, Grand Island, NY (US)

(73) Assignee: R.R. Donnelley & Sons, Inc., Chicago, IL (US)

( * ) Notice: Subject to any disclaimer, the term of this patent is extended or adjusted under 35 U.S.C. 154(b) by 0 days.

(21) Appl. No.: 13/791,776

(22) Filed: Mar. 8, 2013

(65) Prior Publication Data

US 2013/0265365 A1 Oct. 10, 2013

Related U.S. Application Data

(60) Provisional application No. 61/685,002, filed on Mar. 9, 2012.

(51) Int. Cl.
*B41J 2/165* (2006.01)
*B41J 25/00* (2006.01)

(52) U.S. Cl.
CPC ..... *B41J 2/16538* (2013.01); *B41J 25/001* (2013.01); *B41J 2/16535* (2013.01); *B41J 2/16505* (2013.01); *B41J 2/16544* (2013.01)
USPC ..... 347/33

(58) Field of Classification Search
CPC ..... B41J 2/16541; B41J 2/16517; B41J 2/16538; B41J 2/04563
USPC ..... 347/22, 29, 33
See application file for complete search history.

(56) References Cited

U.S. PATENT DOCUMENTS

| | | | |
|---|---|---|---|
| 5,087,805 | A | 2/1992 | Silverschotz et al. |
| 5,126,752 | A | 6/1992 | Weinberg |
| 5,126,766 | A | 6/1992 | Terasawa et al. |
| 5,210,550 | A | 5/1993 | Fisher et al. |

(Continued)

FOREIGN PATENT DOCUMENTS

| | | |
|---|---|---|
| EP | 0376345 | 12/1989 |

OTHER PUBLICATIONS

International Search Report and Written Opinion of International Application No. PCT/US2013/030047, dated Jul. 2, 2013, Applicants R.R. Donnelley & Sons Company (9 pages).

*Primary Examiner* — An Do
(74) *Attorney, Agent, or Firm* — McCracken & Gillen LLC

(57) ABSTRACT

A printing system includes a print unit and a cleaning unit. The print unit comprises a carrier for a plurality of inkjet cartridges. The cleaning unit includes a wiping unit, a cleaning bay, and a wiper washer unit. The wiping unit includes wiper blades and the wiper washer unit includes a plurality of spray nozzles that spray a fluid. A controller is adapted to transport the carrier into the cleaning bay, transport the wiping units such that the wiper blades clean the inkjet cartridges, and actuate the spray nozzles to wash the wiper blades. The carrier may be positioned in the cleaning bay when the inkjet cartridges are not used for printing and the controller controls at least one of humidity and temperature in the cleaning bay when the carrier plate is positioned therein.

26 Claims, 16 Drawing Sheets

(56) References Cited

U.S. PATENT DOCUMENTS

| | | | | |
|---|---|---|---|---|
| 5,211,493 | A | 5/1993 | Stephenson et al. | |
| 5,369,429 | A | 11/1994 | Erickson | |
| 5,382,969 | A | 1/1995 | Mochizuki et al. | |
| 5,446,486 | A | 8/1995 | Reis | |
| 5,504,510 | A | 4/1996 | Miyakawa | |
| 5,512,924 | A | 4/1996 | Takada et al. | |
| 5,631,676 | A | 5/1997 | Karz | |
| 5,751,327 | A | 5/1998 | De Cock et al. | |
| 5,793,389 | A | 8/1998 | Mitchell | |
| 5,825,380 | A | 10/1998 | Ichizawa et al. | |
| 5,877,788 | A | 3/1999 | Haan et al. | |
| 5,923,347 | A | 7/1999 | Wade | |
| 5,929,877 | A | 7/1999 | Hetzer et al. | |
| 5,929,878 | A | 7/1999 | Pelletier | |
| 5,992,990 | A | 11/1999 | Childers et al. | |
| 6,000,792 | A | 12/1999 | Koizumi et al. | |
| 6,030,074 | A | 2/2000 | Barinaga | |
| 6,089,693 | A | 7/2000 | Drake et al. | |
| 6,224,198 | B1 | 5/2001 | Cook et al. | |
| 6,273,103 | B1 | 8/2001 | Enz et al. | |
| 6,344,904 | B1 | 2/2002 | Mercer | |
| 6,357,854 | B1 | 3/2002 | Igval et al. | |
| 6,364,451 | B1 | 4/2002 | Silverbrook | |
| 6,402,293 | B1 | 6/2002 | Sawicki | |
| 6,435,637 | B1 | 8/2002 | Lyman | |
| 6,435,647 | B2 * | 8/2002 | Faisst et al. | 347/28 |
| 6,478,402 | B1 | 11/2002 | Greive | |
| 6,530,644 | B2 | 3/2003 | Premnath et al. | |
| 6,536,863 | B1 | 3/2003 | Beauchamp et al. | |
| 6,575,554 | B2 | 6/2003 | Yoshinaga | |
| 6,575,556 | B1 | 6/2003 | Eremity et al. | |
| 6,601,951 | B2 | 8/2003 | Kuwabara et al. | |
| 6,660,103 | B1 | 12/2003 | Johnston et al. | |
| 6,663,220 | B2 | 12/2003 | Suzuki et al. | |
| 6,669,327 | B1 | 12/2003 | Harper | |
| 6,679,590 | B2 | 1/2004 | Enz | |
| 6,733,106 | B1 | 5/2004 | Leemhuis | |
| 6,802,588 | B2 | 10/2004 | Garbacz et al. | |
| 6,808,246 | B2 | 10/2004 | Long | |
| 6,830,315 | B2 | 12/2004 | Silverbrook et al. | |
| 6,843,553 | B2 | 1/2005 | Ishii et al. | |
| 6,869,160 | B2 | 3/2005 | West et al. | |
| 6,880,912 | B2 | 4/2005 | Klausbruckner et al. | |
| 6,890,053 | B2 | 5/2005 | Myhill et al. | |
| 6,908,165 | B2 | 6/2005 | Pinard | |
| 6,991,311 | B2 | 1/2006 | Su et al. | |
| 7,070,250 | B2 | 7/2006 | Lester et al. | |
| 7,118,189 | B2 | 10/2006 | Kueseter et al. | |
| 7,212,319 | B2 | 5/2007 | Mercer | |
| 7,384,119 | B2 | 6/2008 | Karppinen et al. | |
| 7,401,888 | B2 | 7/2008 | Karppinen et al. | |
| 8,251,488 | B2 * | 8/2012 | Mealy et al. | 347/33 |
| 2004/0061736 | A1 | 4/2004 | Yun et al. | |
| 2004/0066428 | A1 | 4/2004 | West et al. | |
| 2005/0099469 | A1 | 5/2005 | Encrenaz et al. | |
| 2005/0219589 | A1 | 10/2005 | Mercer | |
| 2009/0244124 | A1 | 10/2009 | Kondo | |

* cited by examiner

SYSTEM AND METHOD FOR CLEANING INKJET CARTRIDGES

CROSS-REFERENCE TO RELATED APPLICATION

The present application claims the benefit of Moscato et al., U.S. Provisional Patent Application No. 61/685,002, filed on Mar. 9, 2012, and entitled "System and Method of Cleaning Inkjet Cartridges." The entire contents of such application are incorporated herein by reference.

BACKGROUND OF THE INVENTION

1. Field of the Disclosure

The present disclosure relates generally to inkjet printing systems and more particularly to systems and method for cleaning inkjet cartridges used in such systems.

2. Background of the Invention

High-speed printing systems typically include one or more imaging units. Each imaging unit has one or more inkjet cartridges and a controller controls each inkjet cartridge to eject a fluid (such as ink or other composition) onto a receiving surface. Each inkjet cartridge includes a nozzle plate that includes a plurality of orifices (nozzles) through which ink from inside the inkjet cartridge may be controllably ejected.

An inkjet cartridge typically includes a fluid chamber and one or more nozzles. Pressure inside of the fluid chamber is increased relative to ambient air pressure to force a drop of fluid through the nozzle(s). Some inkjet cartridges use a piezoelectric element that deforms a wall of the fluid chamber to reduce the volume thereof and thereby increase the pressure within the fluid chamber. Alternately, a heating element may be used to vaporize some of the fluid (or a constituent of the fluid such as a fluid carrier or a solvent) in the fluid chamber to form a bubble therein, which increases the pressure inside the fluid chamber. A controller controls the current that is passed through the piezoelectric element to control the deformation thereof or to control the current through the heating element in turn to control the temperature thereof so that drops are formed when needed. Other types of inkjet technologies known in the art may be used in the printing systems described herein.

In a printing system, an inkjet cartridge is secured to a carrier and disposed such that the nozzles of the inkjet cartridge are directed toward the receiving surface. The carrier may be manufactured from steel or other alloys that can be milled to a high precision. More than one inkjet cartridge may be secured to a carrier in this fashion in a one or two-dimensional array.

Dried ink, dust, paper fibers, and other debris can collect on a nozzle plate or in a nozzle of an inkjet cartridge and prevent proper ejection of ink from the nozzles thereof. The controller of a printing system can undertake periodic cleaning cycles during which ink is purged from the nozzle to release any debris in or near such nozzle. The purged ink and/or debris must be removed from the nozzle plate in the vicinity of the nozzles so that such purged ink and/or debris does not collect thereon and dry to create further debris that will later interfere with ejection of ink from nozzles of the cartridge.

SUMMARY OF THE INVENTION

According to one aspect of the present invention, a printing system includes a carrier, a wiping unit, a wiper transport, and a wiper wash unit. A plurality of inkjet cartridges is disposed on the carrier and the wiping unit includes a plurality of wiper blades. The wiper transport effects relative movement between the carrier and the wiping unit such that the plurality of wiper blades cleans the plurality of inkjet cartridges and a wiper wash unit actuator causes the wiper wash unit to clean the plurality of wipers.

According to another aspect of the present invention, a method of cleaning a plurality of inkjet cartridges disposed on a carrier includes the step of providing a wiping unit, wherein the wiping unit includes a plurality of wipers. The method includes the further steps of effecting relative movement between the wiping unit and the carrier such that the wipers clean the plurality of inkjet cartridges and actuating a wiper wash unit to clean the wiper blades.

According to a further aspect of the present invention, a printing system includes a carrier, a bay, and a transport system. A plurality of inkjet cartridges is disposed on the carrier and the transport system effects relative movement between the carrier and the bay. The printing system also includes a sealing member for the bay. When the carrier is positioned over the bay, the sealing member substantially protects the a surface of the carrier from the environment outside the bay.

According to a still further aspect of the present invention, a method of storing inkjet cartridges disposed on a carrier includes the steps of effecting relative movement between the carrier and a bay, and forming a seal between the carrier and the bay. The seal substantially protects the carrier from the environment outside the bay.

DETAILED DESCRIPTION OF THE PREFERRED EMBODIMENTS

Figure 1:
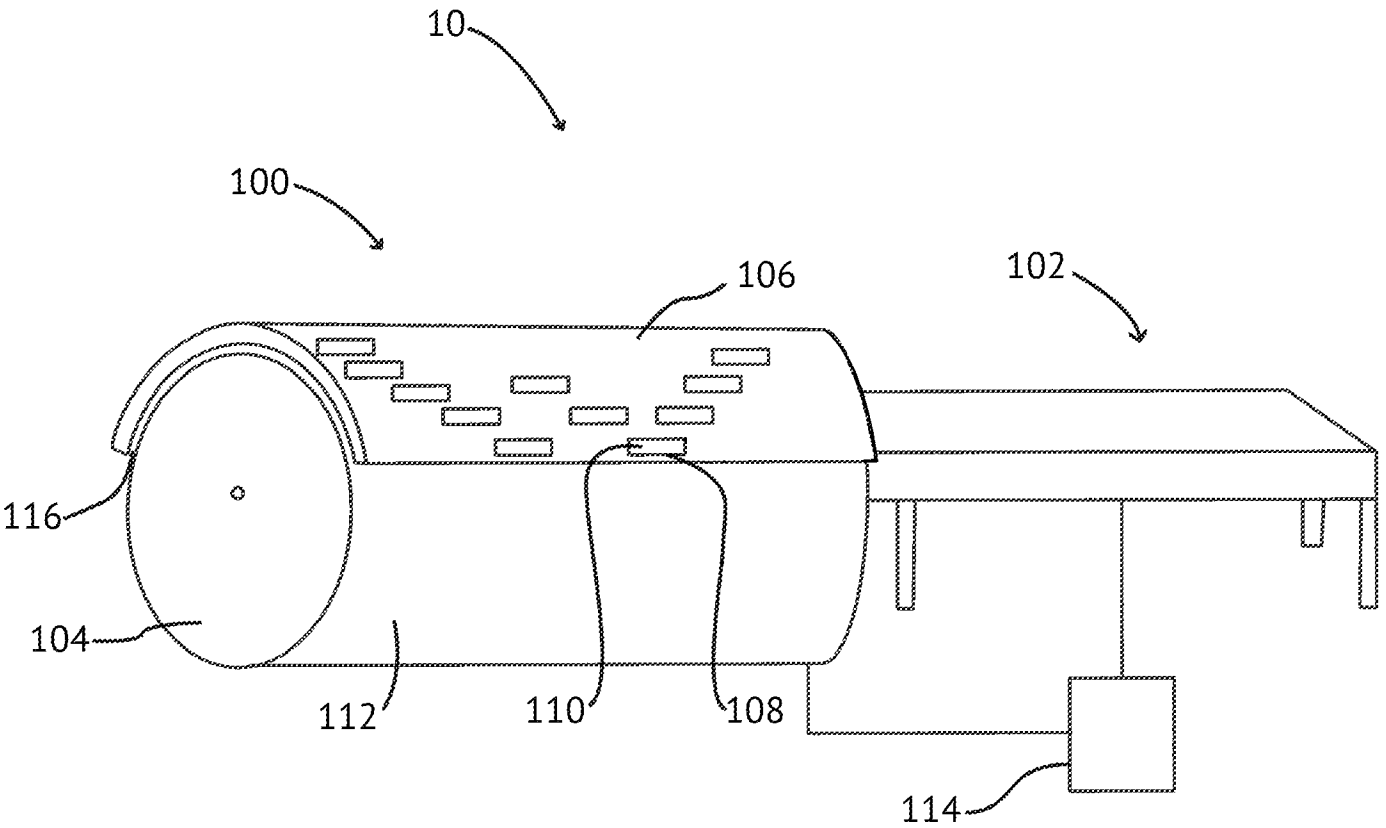
FIGS. 1 and 2 are isometric views of a portion of a printing system according to the present embodiment.

FIG. 1 is a front-left perspective view of a portion of a printing system 10 that includes a print unit 100 and a cleaning unit 102. In particular, the print unit 100 comprises a drum 104 and carrier 106. The carrier plate 106 has an array of slots 108 cut or otherwise formed therethrough such that an inkjet cartridge 110 may be positioned into each such slot 108 and secured to the printhead carrier plate 106. Each inkjet cartridge 110 is positioned in the carrier 106 such that the nozzles of the inkjet cartridge are directed toward the outer surface 112 of the drum 104. U.S. Provisional Patent Application Ser. No. 61/523,079 entitled "Apparatus and Method for Disposing Inkjet Cartridges in a Carrier" discloses one such carrier 106 and how inkjet cartridges 110 may be disposed therein, the entire contents of such application are incorporated herein by reference.

In some printing systems, the inkjet cartridge 110 is secured to a mount (not shown) and the mount is thereafter secured to the carrier 106. U.S. Provisional Patent Application Ser. No. 61/535,150 entitled "Apparatus and Method for Disposing an Inkjet Cartridge in a Mount" discloses one such mount. The entire contents of such application are also incorporated herein by reference.

A controller 114 controls the operation of the print unit 100 and the cleaning unit 102 as is described further hereinafter.

A web of paper (not shown) is transported through a space 116 between the outer surface 112 of the drum 104 and the carrier 106 such that the nozzles of the inkjet cartridges 110 disposed in the carrier 106 face toward the web of paper. In one embodiment, rotation of the drum 104 transports the paper past the nozzles of the inkjet cartridges 110.

FIG. 1 shows the carrier 106 in a printing position in which the inkjet cartridges 110 disposed in the carrier may be used to form an image on the web of paper. In particular, the controller 114 controls ejection of ink through the nozzles of the inkjet cartridges 110 in synchrony with the transport of web of paper between the drum 104 and the carrier 106 to form an image in ink on such paper.

Figure 2:
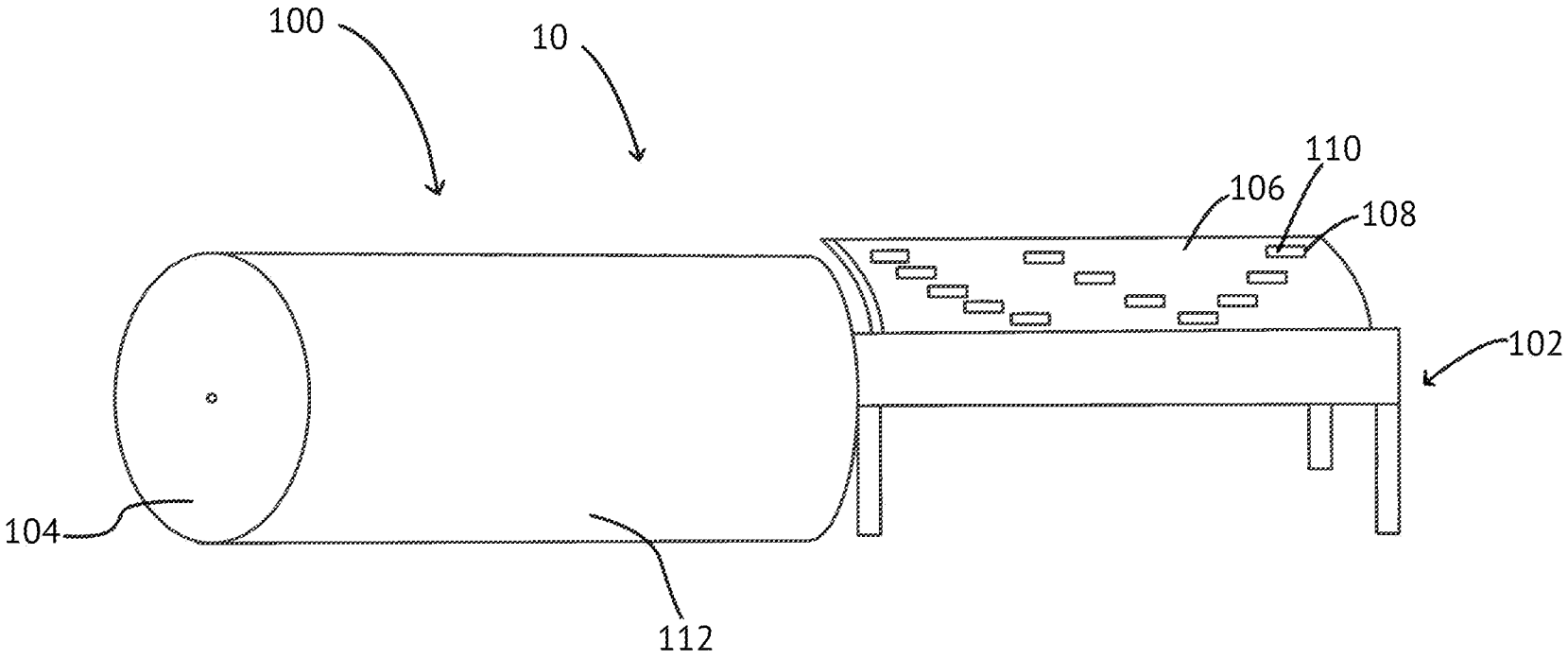

Periodically, the controller 114 initiates a cleaning cycle and moves the carrier 106 into a cleaning position shown in FIG. 2. The controller 114 causes ink from each cartridge 110 to be purged from the nozzles thereof and directs the cleaning unit 102 to clean the outer surface the nozzle plate of each cartridge 110. In a preferred embodiment, the ink is purged from each cartridge 110 for between approximately 0.10 and 0.15 seconds for routine cleaning. For extended cleaning, for example if a nozzle appears to be clogged, or to remove air from the internal ink reservoir of a cartridge 110, ink may be purged for between approximately three to five seconds. It should be apparent that ink may be purged from each inkjet cartridge 110 for a duration that is longer or shorter than described in the foregoing.

In some embodiments, the controller 114 initiates a cleaning cycle after the print unit 100 has been operated for a predetermined period of time. In other embodiments, the controller 114 detects a paper splice or a roll change and initiates the cleaning cycle. In some cases, the controller stops the transport of the paper, for example, by stopping rotation of the drum 104. In other cases, the transport of the paper is uninterrupted while the cleaning cycle is undertaken, for example, if the cleaning cycle coincides with a roll change or a paper splice. It should be apparent that the cleaning cycle could be undertaken at any time while the cartridges 110 are not being used to print and with or without stopping the transport of the web.

FIGS. 3A, 3B, 3C, and 3D are top-elevational, front side, right side, and top-front-right isometric views, respectively, of the cleaning unit 102. The cleaning unit 102 comprises a wiper unit 302 that includes a plurality of wipers 304. In some embodiments, the wiper unit 302 includes a quantity of wipers 304 that is identical to number of rows of the two-dimensional array in which the slots 108 are arranged on the carrier 106. In other embodiments, the wiper unit 302 includes a sufficient quantity of wipers 304 to span the width of the carrier 106 in the paper feed direction of the print unit 100.

The cleaning unit 102 also includes a cleaning bay 306. In one embodiment the cleaning bay 306 has a bottom surface 308 that is angled downward toward a catcher pan 310 disposed in the underside of the cleaning unit 102. The bottom surface 308 is configured such that liquid deposited thereon flows into the catcher pan 310.

The cleaning unit 102 further includes a wiper wash unit 312. The wiper wash unit 312 comprises a plurality spray units, described hereinbelow, supplied by fluid distribution units 314 (for example, a t-joint for directing fluid).The distribution units 314 extend outwardly from a top surface 313 of the wiper wash unit 312. Each fluid distribution unit 314 may supply one or more spray units. The fluid distribution units 314*a* through 314*f* are coupled to one another using, for example, fluid lines (shown for clarity in FIG. 4A) such that fluid supplied from a fluid source to an input port 316*a* of the distribution unit 314*a* may be distributed to all of other fluid distribution units 314*b* through 314*f*. For example, fluid supplied to the input port 316*a* is supplied to spray units associated with the distribution unit 314*a* and to output ports 316*b* and 316*c*. The fluid from the output port 316*b* is supplied to an input port 318 of the distribution unit 314*b* and such fluid is supplied to the spray unit(s) associated therewith. The fluid from the output port 316*c* is supplied to an input port 320*a* of the distribution unit 314*c*. The fluid entering the input port 320*a* is supplied to the spray unit(s) associated with the distribution unit 314*c* and to the output port 320*b*. The fluid from the output port 320*b* is distributed to the input port 322*a* of the distribution unit 314*d* and supplied to the spray unit(s) associated therewith and also to output ports 322*b* and 322*c*. Fluid from the output port 322*b* is provided to an input port 324 of the distribution unit 314*e* and the spray unit(s) associated therewith. The fluid from the output port 322*c* is provided to an input port 326 of the distribution unit 314*f* and the spray unit(s) associated therewith. The fluid supplied to the input port 316*a* may be an aqueous solution, a solvent, a gas, or a combination thereof.

The wiper wash unit 312 includes valves 327*a*, 327*b*, and 327*c* that may be controlled by the controller 114 and an input portion of each valve 327 may be connected to a source of pressurized fluid such as water, a cleaning solution, a gas, air, or a combination thereof. In one embodiment, the valves 327 are electrically controllable solenoid valves. The output ports of one or more of the valves 327 may connected to a common fluid line and the common fluid line connected to the input port 316*a* of the distribution unit 314*a*.

As is described further below, in one embodiment, an aqueous cleaning solution is provided to the input port 316*a* for a first period of time by opening the valve 327 connected to the source of such solution. Thereafter, the valve 327*a* connected to the source of cleaning solution is closed and air is provided for a second period of time by opening the valve 327*c* connected to such air. The controller 114 operates the valves 327 to provide cleaning solution and air as required. Other combinations of fluids over various periods of time may be supplied to the input port 316*a* and thereby to the distribution units 314*a* through 314*f* and the spray units associated therewith.

Figure 4A:
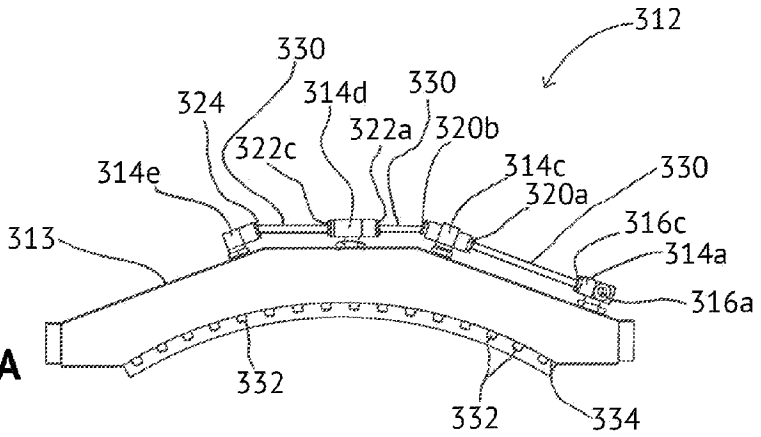
FIGS. 4A and 4B are side and bottom elevational views, respectively, of a wiper wash unit of the cleaning unit of FIGS. 3A-3D.

FIG. 4A is a right-side elevational view of the wiper wash unit 312. As described above, fluid lines 330 interconnect the distribution units 314 so that fluid entering input port 316*a* for the distribution unit 314*a* may be provided to all of the distribution units 314*a* through 314*f* Extending inwardly from an inner surface 334 of the wiper wash unit 312 are spray units 332.

Figure 4B:
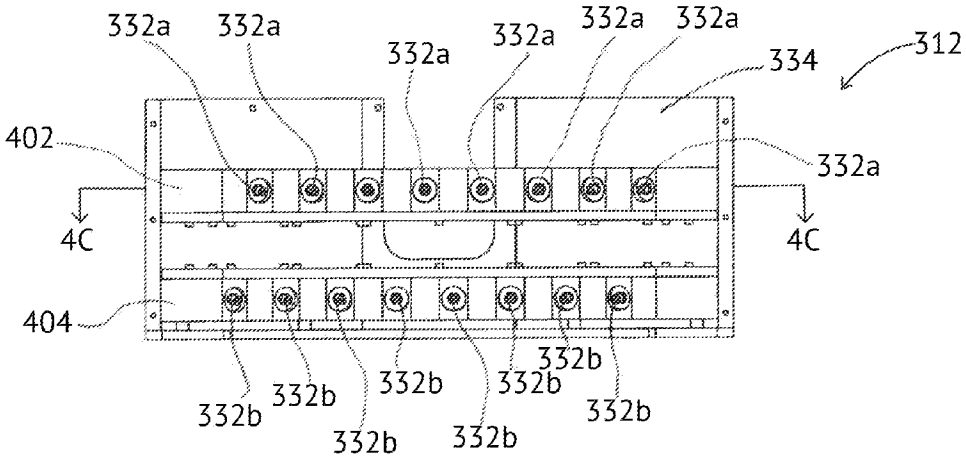

FIG. 4B is a bottom view of the wiper wash unit 312. The spray units 332 are disposed on the inner surface 334 of the wiper wash unit 312 in a pattern that is identical to the arrangement of wipers 304 of the wiper unit 302. In this fashion, when the wiper unit 302 is positioned directly under the wiper wash unit 312, one spray unit 332 is directly above each wiper 304. In some embodiments, one row of spray units 332*a* is disposed on a manifold 402 and a second row of spray units 332*b* is disposed on a manifold 404.

Figure 4C:
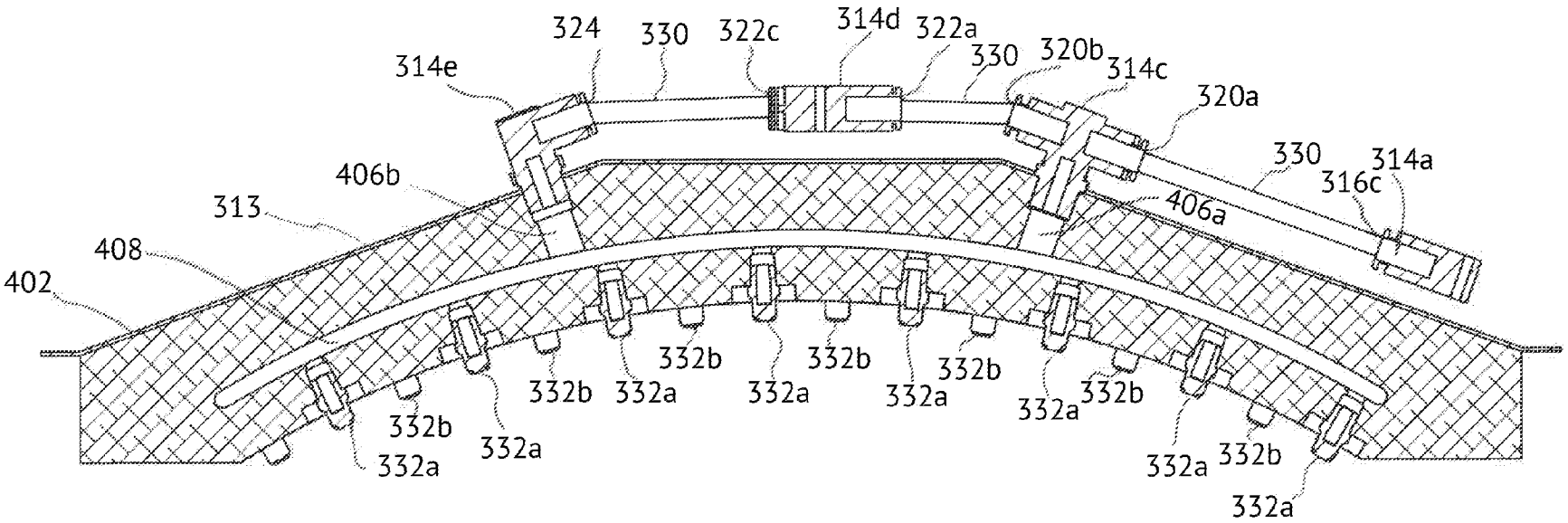
FIG. 4C is a cross-sectional view taken along the line 4C-4C of the wiper wash unit of the cleaning unit of FIGS. 3A-3D.

In one embodiment, the spray units 332 are connected by fluid lines (not shown) to the distribution units 314*a* through 314*e*. Referring to FIG. 4C, in another embodiment, the distribution units 314*c* and 314*e* are connected to paths 406*a* and 406*b*, respectively, inside the manifold 402. The paths 406*a* and 406*b* couple the distribution units 314*c* and 314*e*, respectively, to a cavity 408. The cavity 408 is coupled to each of the spray units 332*a*. Pressurized fluid provided to the distribution units 314*c* and 314*e* is transported into the cavity 408 via the paths 406*a* and 406*b*, respectively, and then from the cavity to the spray units 332*a* and ejected therefrom. The manifold 404, in some embodiments, also includes a cavity (not shown) coupled to the distribution units 314*b* and 314*f*. Pressurized fluid supplied to the distribution units 314*b* and 314*f* is transported through such cavity and to the spray units 332*b* for ejection therefrom.

During a cleaning cycle, the controller 114 actuates motor drives (not shown) in the press unit 100 to position the carrier 106 over the cleaning bay 306. Thereafter, the controller 114 causes the inkjet cartridges 110 to eject ink from the nozzles thereof for a predetermined period of time as described above. Such ejected ink is deposited onto the bottom surface 308 of the cleaning bay 306 and transported by gravity to the catcher pan 310.

Figure 3A:
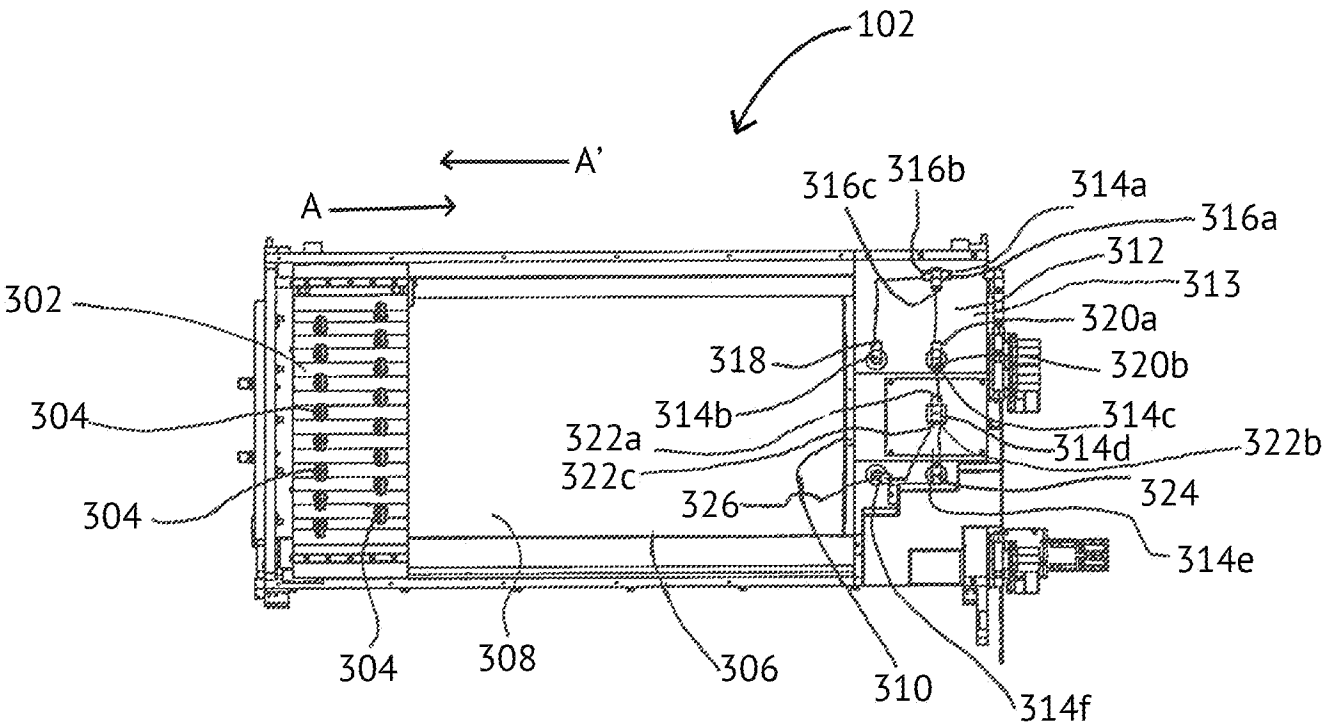
FIGS. 3A, 3B, 3C, and 3D are top elevational, front elevational, side elevational, and isometric views, respectively, of a cleaning unit of the printing system of FIGS. 1 and 2.
Figure 3B:
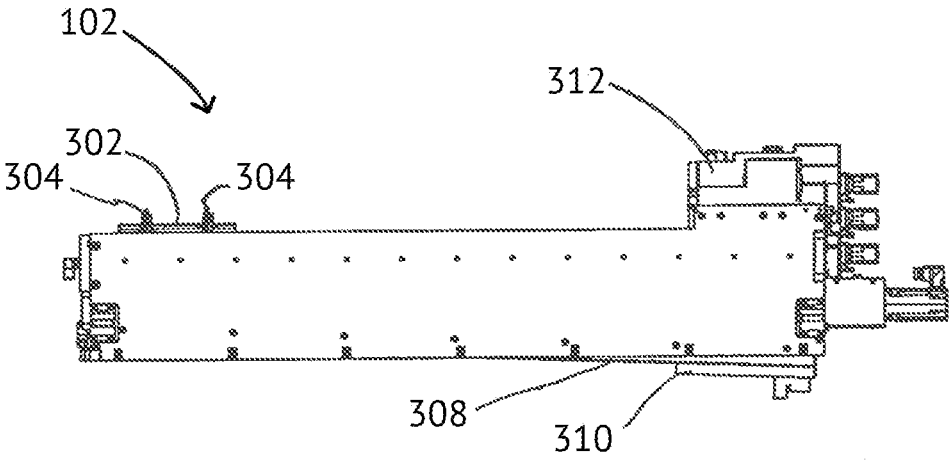
Figure 3C:
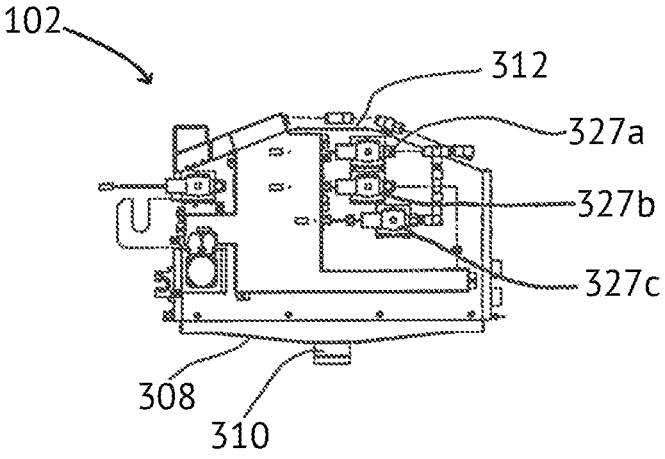
Figure 3D:
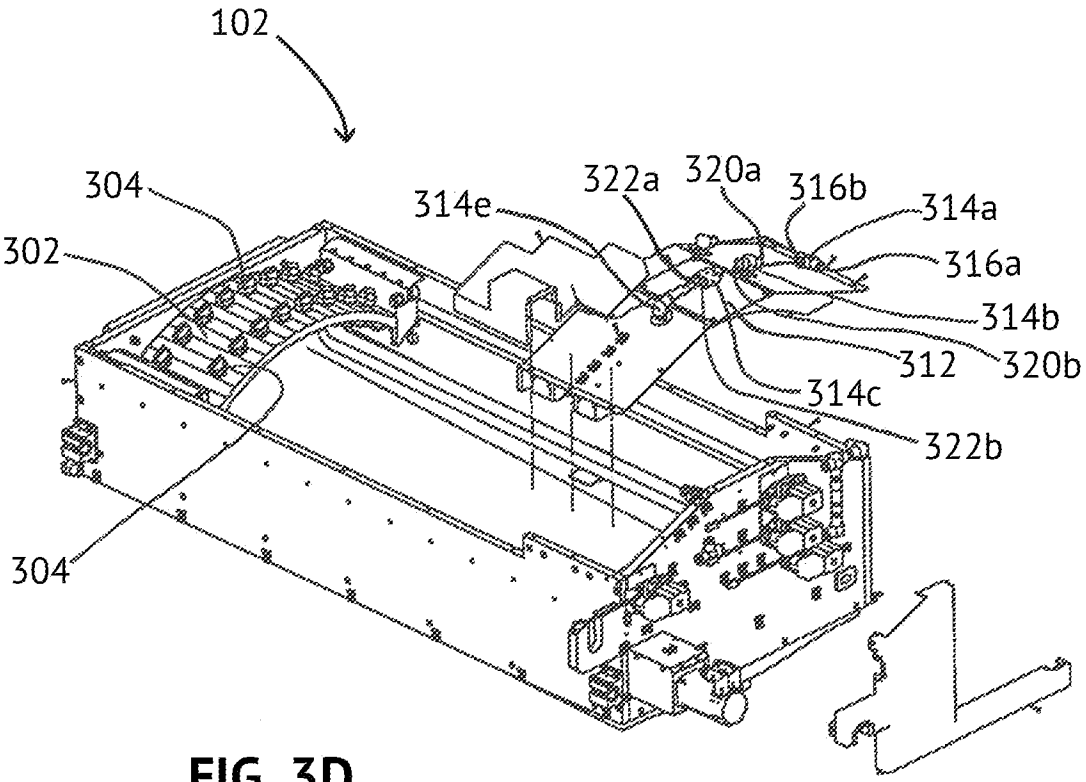

In one embodiment, the controller 114 actuates one or more motors in the cleaning unit 102 associated with the wiper unit 302 to move the wiper unit 302 in the direction A seen in FIG. 3A until the wipers 304 are aligned with a first set of inkjet cartridges 110. In the embodiment of the cleaning unit 102 shown in FIG. 3A, the wiper unit 302 comprises 16 wipers 304 arranged into two columns of eight wipers. The first set of inkjet cartridges 110 includes those inkjet cartridges 110 disposed in the slots 108 that comprise two columns nearest the wiper unit 302. As will be described below, the controller 114 actuates a pneumatic lifter associated with each wiper 304 so that the nozzle plate of each inkjet cartridge 110 in the first set is contacted by a wiper 304. Thereafter, the controller 114 actuates the motor of the wiper unit 302 to move the wiper unit 302 in the direction A a distance identical to the width of a nozzle plate on an inkjet cartridge 110 thereby wiping the surface of such nozzle plate with the wiper 304. In some embodiments, the controller 114 releases the pneumatic lifter associated with each wiper 304 to return such wiper to a resting position. Thereafter, the controller 114 actuates the motor of the wiper unit 302 to move the wiper unit 302 in the direction A to a next set of the inkjet cartridges 110 and repeats the wiping process described above. The controller 114 continues to move the wiper unit 302 in this fashion until all of the cartridges 110 on a carrier 106 have been wiped. Thereafter the controller 114 actuates the motor of the wiper unit 302 to move the wiper unit 302 such that the wiper unit 302 is positioned under the wiper wash unit 312. Once the wiper unit 302 is positioned under the wiper wash unit 312, the controller 114 actuates one of the valves 327 to supply a cleaning fluid to the input port 316*a* of the distribution unit 314*a*. The cleaning fluid is supplied at a sufficient pressure so that the fluid is distributed to each distribution unit 314 and ejected from each spray unit 332. Further, the supply pressure is selected such that the cleaning fluid is ejected from each spray unit 332 with sufficient force to wash away any ink accumulated on the wipers 304. In a preferred embodiment, the pressure with which the cleaning fluid is supplied is between approximately 25 and 50 pounds-per-square-inch (PSI). The controller 114 actuates the valve 327 for a predetermined amount of time to wash the wipers 304.

In some embodiments, after wipers 304 have been washed with the cleaning fluid, the controller 114 actuates another of the valves 327 to supply a drying fluid (such as air) to the input nozzle 316*a*. Again, the drying fluid is supplied with sufficient pressure so that such fluid is distributed to each of the distribution units 314 and is forcefully ejected from each spray unit 332. In a preferred embodiment, the drying fluid is air and is supplied to the input port 316*a* at a pressure of between approximately 60 and 90 PSI. In addition, the drying fluid is supplied for a predetermined amount of time to dry the wipers 304. In other embodiments, the wipers 304 are allowed to air dry.

After the wipers 304 have been cleaned as described hereinabove, the controller 114 actuates the motor of the wiper unit 302 to cause the wiper unit 302 to move the direction A' until the wiper unit 302 is positioned at the left most position of the cleaning unit (as shown in FIG. 3A). It should be apparent that terms left and right (as well as other directional terms) are used herein to provide reference only and not to limit the embodiments described.

In some embodiments, the wiper unit 302 is parked under the wiper wash unit 312 when not in use. In such embodiments, the controller 114 actuates motor of the wiper unit 302 to move the wiper unit 302 in the direction A' until the wipers 304 are aligned with a set of inkjet cartridges 110 nearest the wiper wash unit 312. The controller 114 actuates the pneumatic lifter with each wiper 304 so that the wiper 304 contacts the nozzle plate of each inkjet cartridge 110 in such set of inkjet cartridges 110. Thereafter, the controller 114 actuates the motor of the wiper unit 302 to move the wiper unit 302 in the direction A' a distance identical to the width of the nozzle plate of an inkjet cartridge 110, thereby wiping the surface of such nozzle plate with the wiper 304. The controller 114 thereafter releases the pneumatic lifter associated with each wiper 304 to return such wiper to a resting position. The controller 114 then actuates the motor of the wiper unit 302 to move the wiper unit 302 in the direction A' to the next set of cartridges 110 and repeats the wiping process. After all of the cartridges 110 have been wiped in this fashion, the controller actuates the motor of the wiper unit 302 to move the wiper unit 302 in the direction A to be positioned under the wiper wash unit 312. Thereafter, the wiper wash unit 312 cleans the wipers 304 of the wiper unit 302 as described above.

In one embodiment, the controller 114 transports the wiper unit 302 into position under the wiper wash unit 312 and directs a wiper cleaning cycle described above after each set of inkjet cartridges 110 are wiped. It should be apparent that such wiper cleaning cycle may be undertaken periodically during the cleaning of the inkjet cartridges 110 secured to the carrier 106.

In one embodiment, one or more spray unit(s) (not shown) may be disposed in the cleaning unit so that fluid ejected therefrom may clean the bottom and/or side surfaces of the cleaning Fluid lines to one or more of the valve(s) 327 connect such spray unit(s) and the controller 114 opens such valve periodically to clean such bottom and/or side surfaces.

Figure 5:
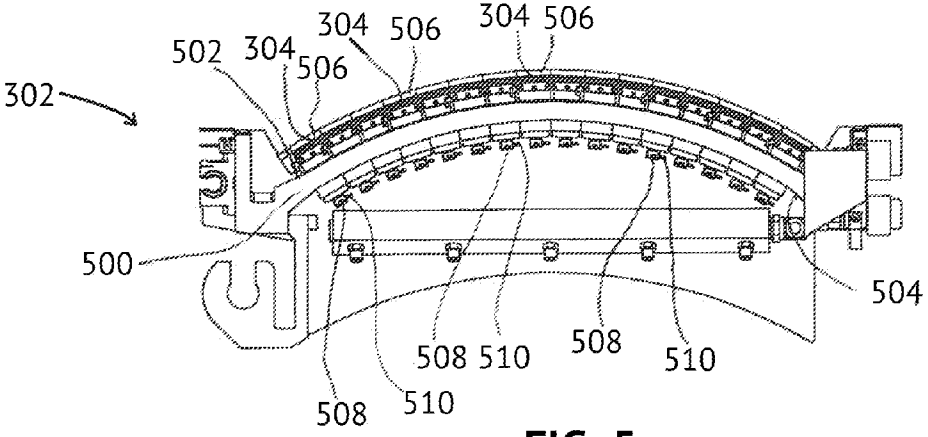
FIG. 5 is another side elevational view of the wiper unit of FIGS. 3A-3D.

FIG. 5 is a left-side elevational view of the wiper unit 302. The wiper unit 302 includes a mounting structure 500 that has a top surface 520 and a bottom surface 504. The mounting structure 500 has a profile that is substantially parallel to a profile of the carrier 106. For example, the profile of the mounting structure 500 is arcuate to be parallel with a carrier 106 that also has an arcuate profile. The mounting structure 500 has a plurality of slots therethrough into which each wiper 304 may be passed and secured to the mounting structure 500. Each wiper 304 includes a wiper blade 506 that extends outwardly therefrom. The wiper 304 also includes a port 510 that descends downwardly therefrom and such port includes a connector 508 that may be connected to a fluid line through which a pressurized fluid may be supplied. In a preferred embodiment, the pressurized fluid is air. It should be apparent that the pressurized fluid may comprise other gas mixtures, gas compounds, or liquids.

Figure 6A:
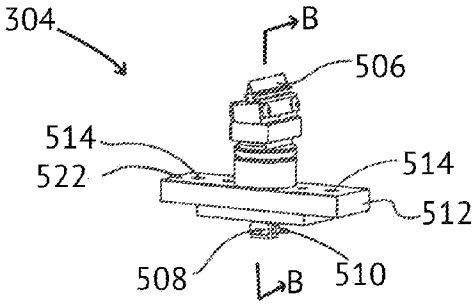
FIGS. 6A, 6B, and 6C are isometric, sectional and exploded views, respectively, of a wiper of the cleaning unit of FIGS. 3A-3D.
Figure 6C:
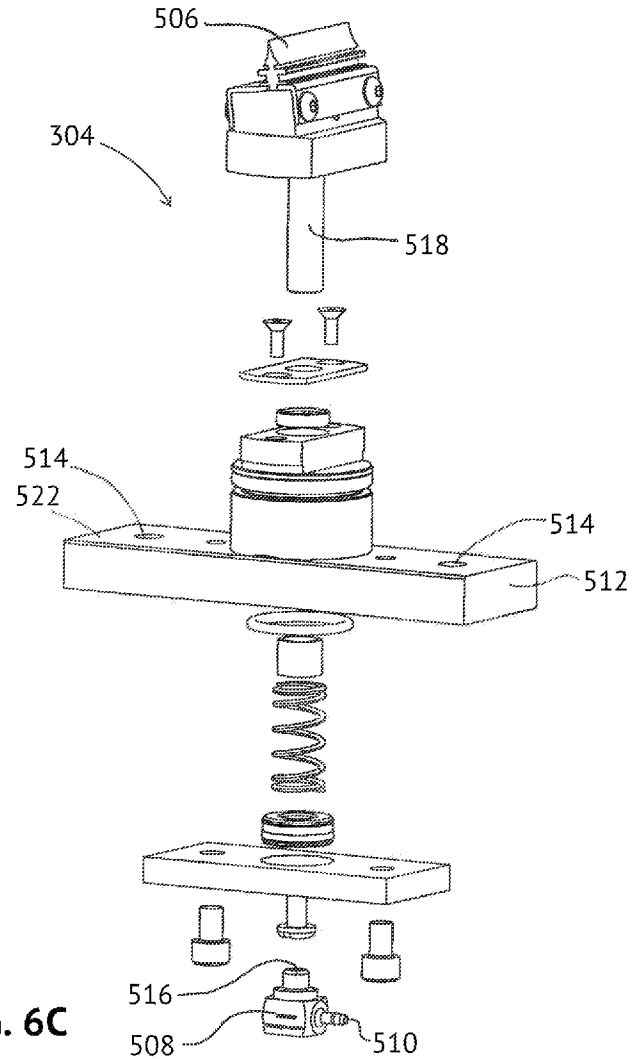
Figure 6B:
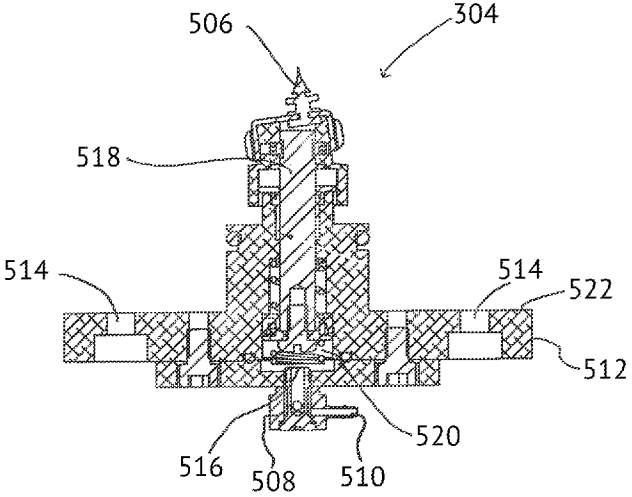

FIG. 6A is a top-left-front isometric view of a wiper 304. The wiper blade 506 extends outward from a mounting plate 512 and the connector 508 extends downward from such mounting plate. The mounting plate 512 includes screw holes 514 that are used to attach the mounting plate 512 to the mounting structure 500 of the wiper unit 302. FIG. 6B is a sectional view of the wiper 304 taken along the lines B-B of FIG. 6A. FIG. 6C is an exploded view of the wiper 304. The wiper blade 506 is attached to a piston 518, which is coupled to an interior cavity 520 of the wiper 304. The port 510 includes an output port 516 that opens into the interior cavity 520 of the wiper 304. When pressurized gas is supplied through the input port 510, such pressurized gas is exhausted into the interior cavity 520, which causes an increase in the pressure inside the cavity 520. Such an increase in pressure urges the piston 518 to move upward in the direction C, thereby causing the wiper blade 506 to rise. As described above, the controller 114 actuates a source of pressurized gas (not shown) to supply the pressurized gas to the port 510 to lift the wiper blade 506 portion of the wiper 304 to contact the bottom face of the nozzle plate of the inkjet cartridge 110.

In one embodiment, the piston 518 may be threaded and a screw (not shown) may be provided in the interior portion of the wiper 304. An operator may turn the piston 518 and, therefore, the wiper blade 506 to adjust the distance between the piston 518 and the top surface 522 of the mounting plate 512 to be adjusted. Each turn of the piston 518 is associated with a predetermined change in the distance between such piston 519 and the top surface 522. In one embodiment the pitch of the thread is 1/32 of one inch and each turn adjusts the distance accordingly. Such adjustment allows and operator to precisely position the wiper 304 with respect to a nozzle plate that is cleaned by such wiper 304.

Figure 7:
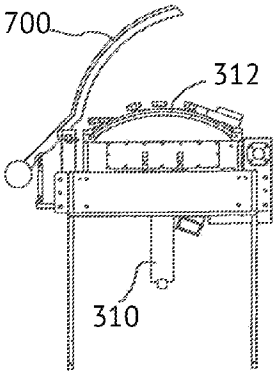
FIG. 7 is a side elevational view of the cleaning unit of the printing system of FIGS. 1 and 2.
Figure 9:
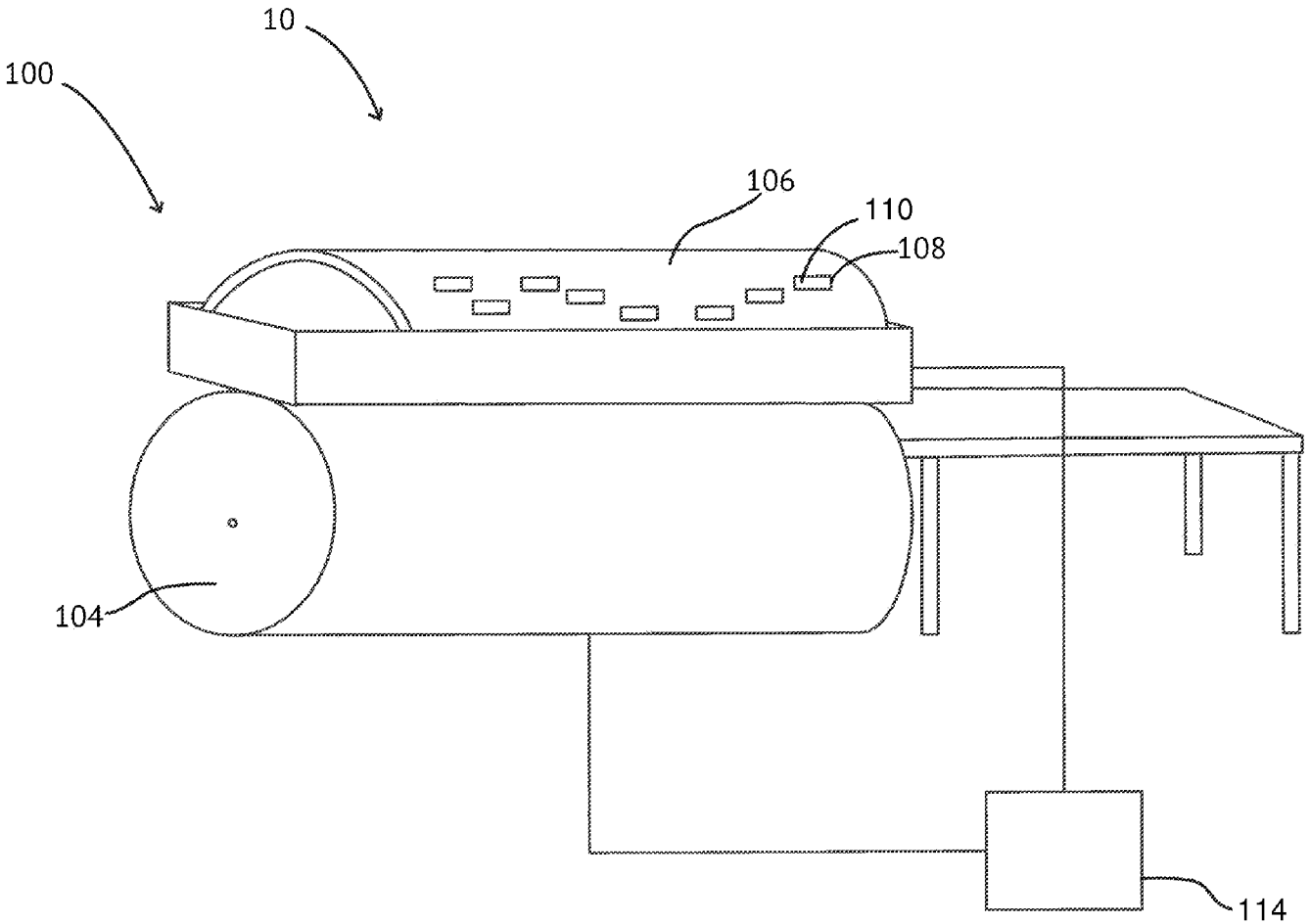
FIG. 9 is an isometric view of another embodiment of the printing system of FIG. 1.

The cleaning unit 102 may be used to provide a controlled environment in which to park the carrier 106 and the inkjet cartridges 110 mounted therein when such inkjet cartridges 110 are not being operated to print. FIG. 7 is a left elevational view of an embodiment of the cleaning unit 102. Referring to FIGS. 3A, 4B, and 7, the cleaning unit 102 may include a cover 700 that may be closed when the carrier 106 is in the cleaning bay 306. When closed, the cover provides a sealed enclosure for the carrier 106 that prevents debris from contaminating the inkjet cartridges 110 and provides a temperature and humidity controlled environment. Further, in some embodiments, the cleaning bay 306 may include sensors (not shown) coupled to the controller 114 to provide readings of the humidity and the temperature inside the cleaning bay 306. If the humidity drops below a predetermined level, the controller 114 may actuate one of the valves 327 to cause liquid (such as cleaning fluid or treated water) to be supplied to the nozzle 314*a* of the wiper washer unit 312 and ejected from the spray units 332 thereof. If the humidity is above a predetermined level, the controller 114 may actuate one of the valves 327 to cause dry air or gas to be supplied to the nozzle 314*a* and thereby ejected through the spray units 332. Temperature in the cleaning bay 306 may be controlled by adjusting the humidity and/or by introducing warmed or cooled fluid into the cleaning bay in a similar fashion through the spray nozzles 332. Maintaining the humidity and temperature in this manner prevents drying of ink at the nozzles and allows the inkjet cartridges 110 in the carrier 106 to be maintained in a print ready state that minimizes the need to prime or purge ink from such inkjet cartridges before being used to print. Further, the inkjet cartridges 110 in the carrier 106 do not have to be sealed or capped because the cover provides a substantially sealed environment for all of the cartridges 110 in the carrier 106. Such sealed environment also protects the wiper unit 302 and the wiper wash unit 312 when not being used.

Because, with the cover 700 in a closed position, the carrier 106 and the cartridges 110 are in a sealed environment, the controller 114 may adjust the ambient pressure in such environment as necessary. For example, the controller 114 may increase the ambient pressure introducing air from one or more of the spray unit(s) 332 or decrease the ambient pressure by actuating a vacuum (not shown). The pressure may be increased, for example, to force ink into the body of the inkjet cartridge 110 and away from the nozzles thereof. Alternately, the pressured may be decreased to cause ink to weep from the nozzles of the inkjet cartridge 110.

When the carrier 106 and the inkjet cartridges 110 are in the parked position, the controller may adjust the pressure with which ink is supplied to the cartridges 110, for example, to cause the inkjet cartridges 110 to weep ink from nozzles thereof periodically. It should also be apparent that the controller 114 may exercise the heads (e.g., by purging ink) periodically while the carrier is in the parked position to ensure that the cartridges 110 are maintained in a print-ready state.

Figure 8A:
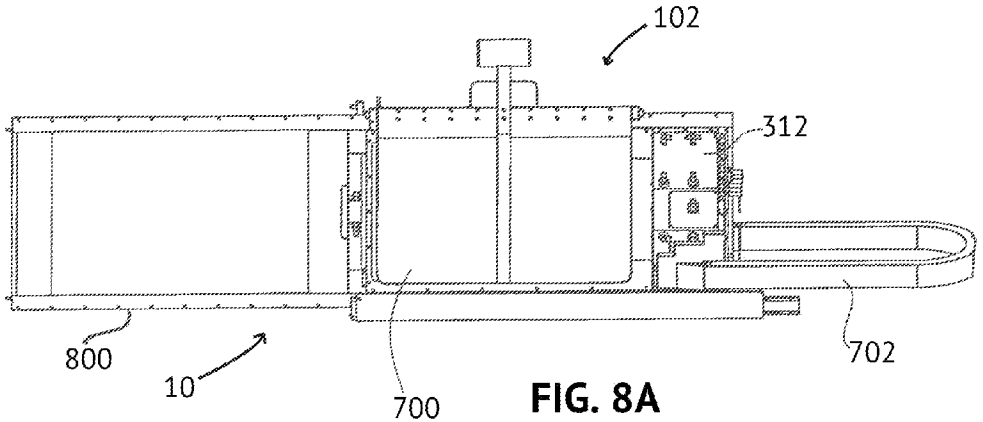
FIGS. 8A and 8B are top and side elevational views of the printing system of FIGS. 1 and 2.
Figure 8B:
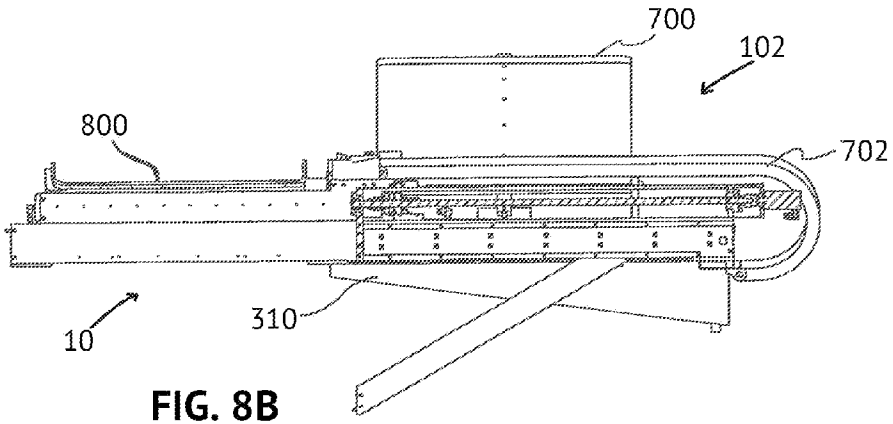

FIGS. 8A and 8B are top and side elevational views, respectively, of the printing system 10 without the print unit 100. As shown, the cleaning unit 102 is coupled to a frame 800 of the printing system 10 to form a cohesive structure. The carrier 106 may be secured to the frame 800 and the frame may be disposed above the drum 10. Further, a conduit 702 is provided to allow electrical cables and fluid lines to be contained when the various elements of the printing and cleaning unit are transported in the manner described herein above.

Referring once again to FIG. 1, in an alternative embodiment of the printing system 10, instead of moving the carrier 106 to the cleaning unit 102, the controller 114 actuates lifters (not shown) that lift the carrier 106 upward away from the drum 104 and actuates motors (not shown) to transport the cleaning unit 102 into a position between the drum 104 and the carrier 106, and the carrier 106 is positioned downward into the cleaning bay 306. FIG. 2 is a front elevational view of the printing system 10 with the carrier 106 and the cleaning unit 102 in such cleaning position. The operation of the cleaning unit 102 is otherwise substantially identical to that described hereinabove. In such embodiment, the carrier 106 is lifted between about 9 and 10 inches from the printing position thereof and the cleaning unit 102 is position to be about 0.5 inches above the drum 104.

In some embodiments the cover 700 is closed during a cleaning cycle or a portion thereof. In other embodiment the cover 700 may be kept open or partially closed during a cleaning cycle or portion thereof. Further, it should be apparent that when the carrier 106 is moved into the cleaning unit 102 or when the cleaning unit 102 is moved under the carrier 106, the cover 700 may be closed during transport, and then opened while the carrier 106 is positioned into the cleaning bay 306.

Figure 10:
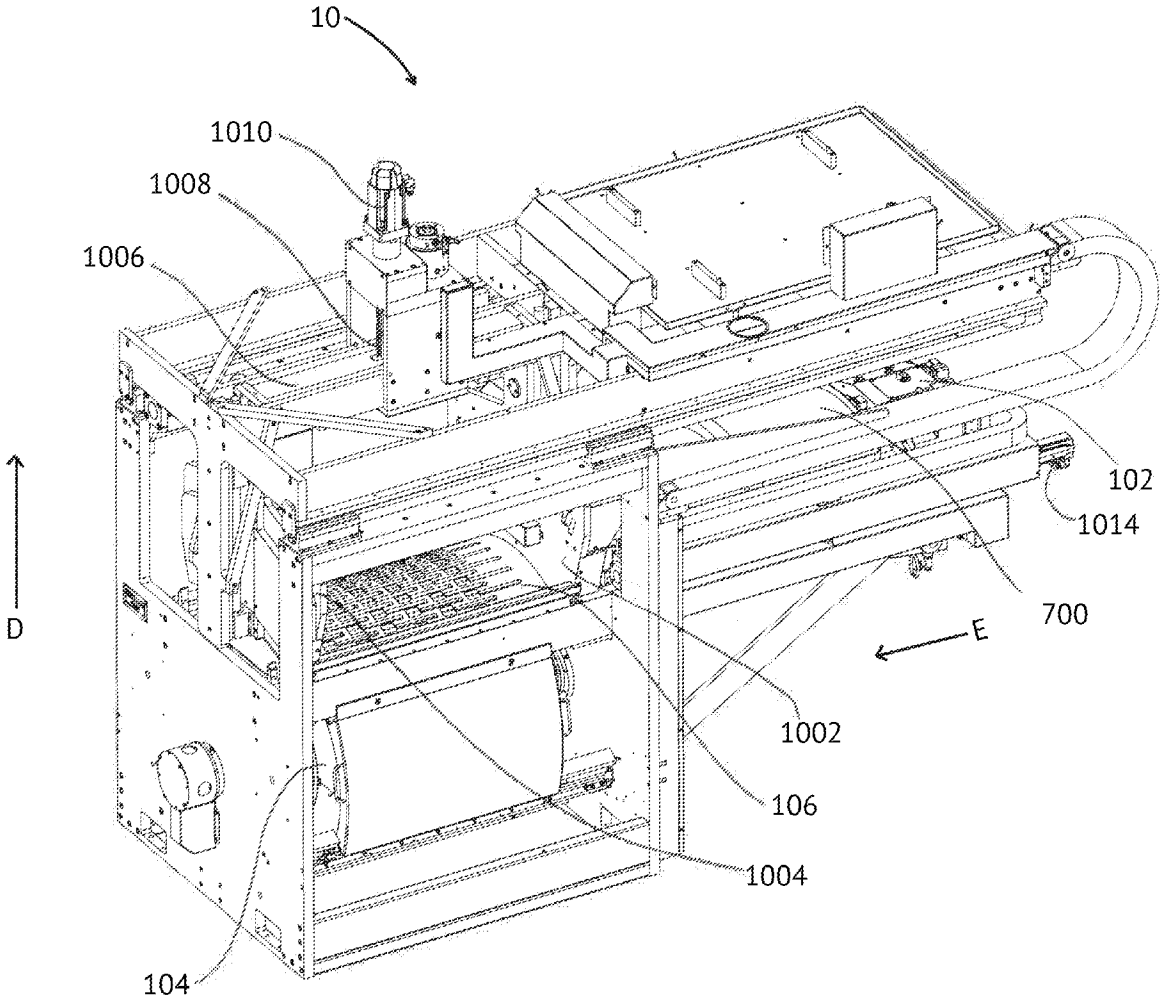
FIG. 10 is a top, front, and right-side isometric view of the another embodiment of the printing system of FIG. 1.
Figure 11A:
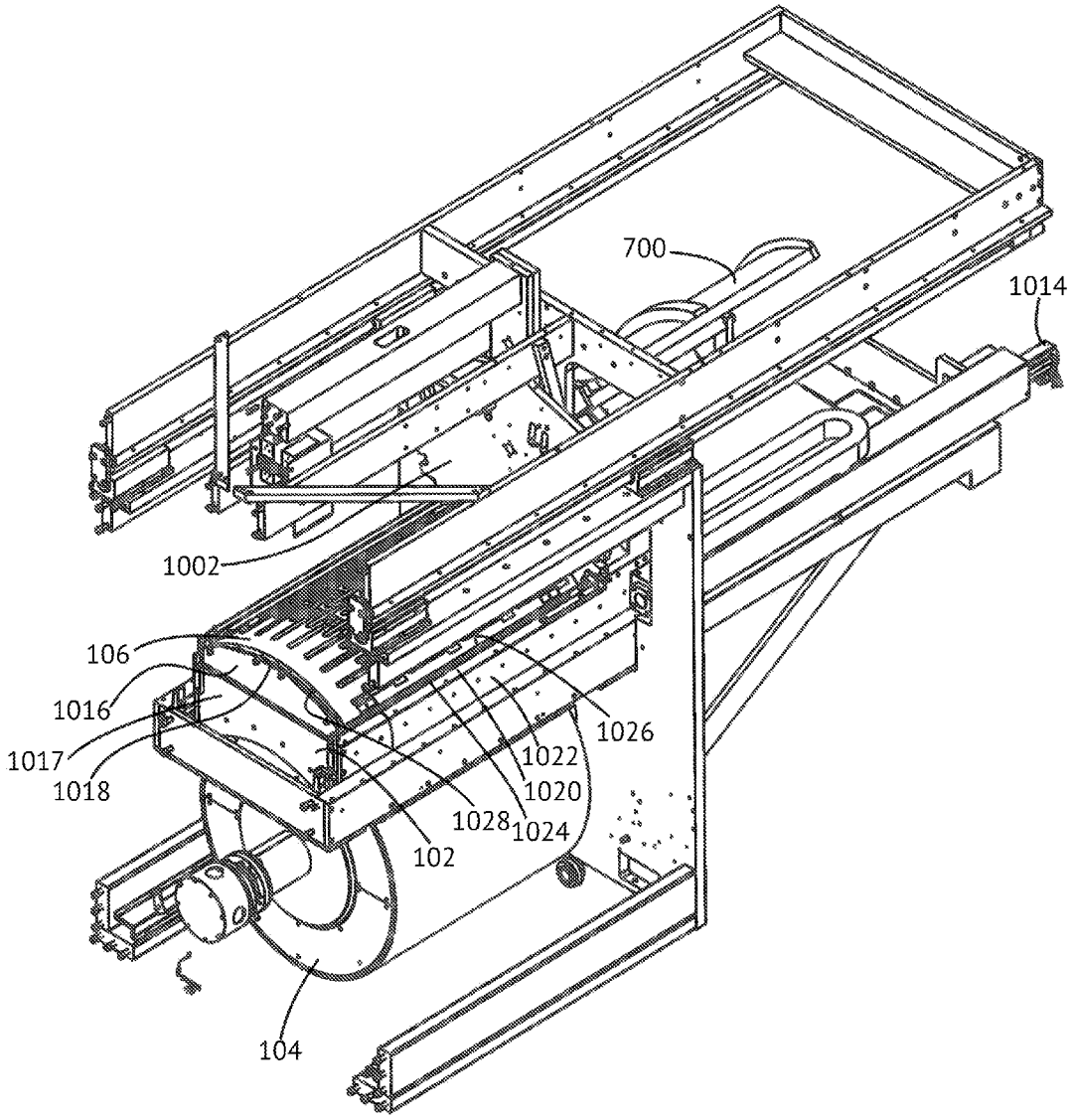
FIG. 11A is another isometric view of the printing system of FIG. 10.
Figure 11B:
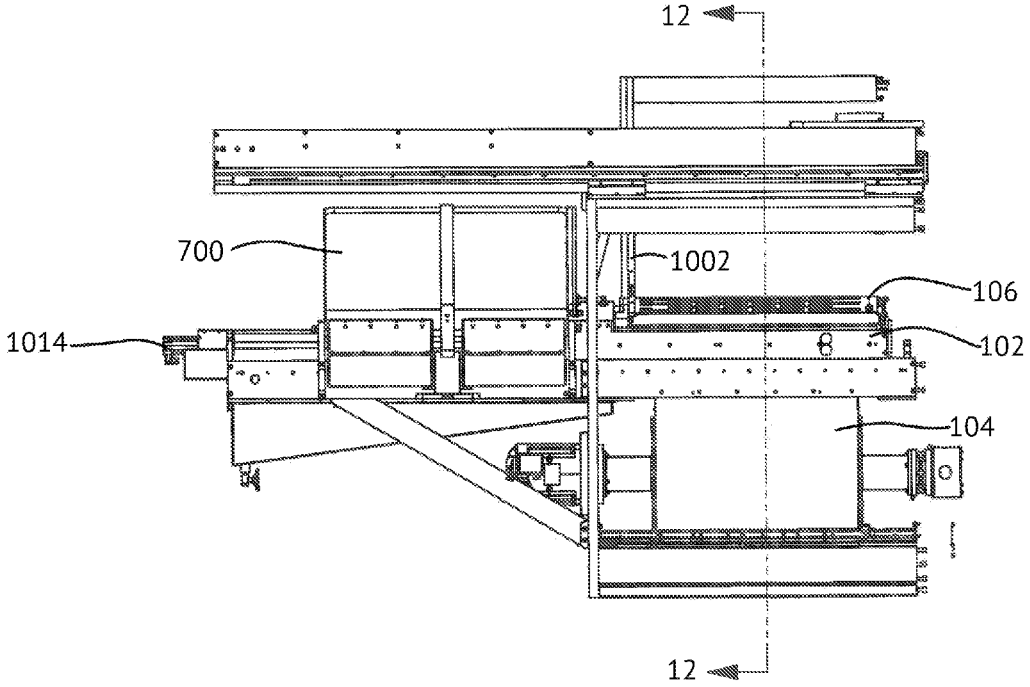
FIG. 11B is a rear planar view of the printing system of FIG. 10.
Figure 12:
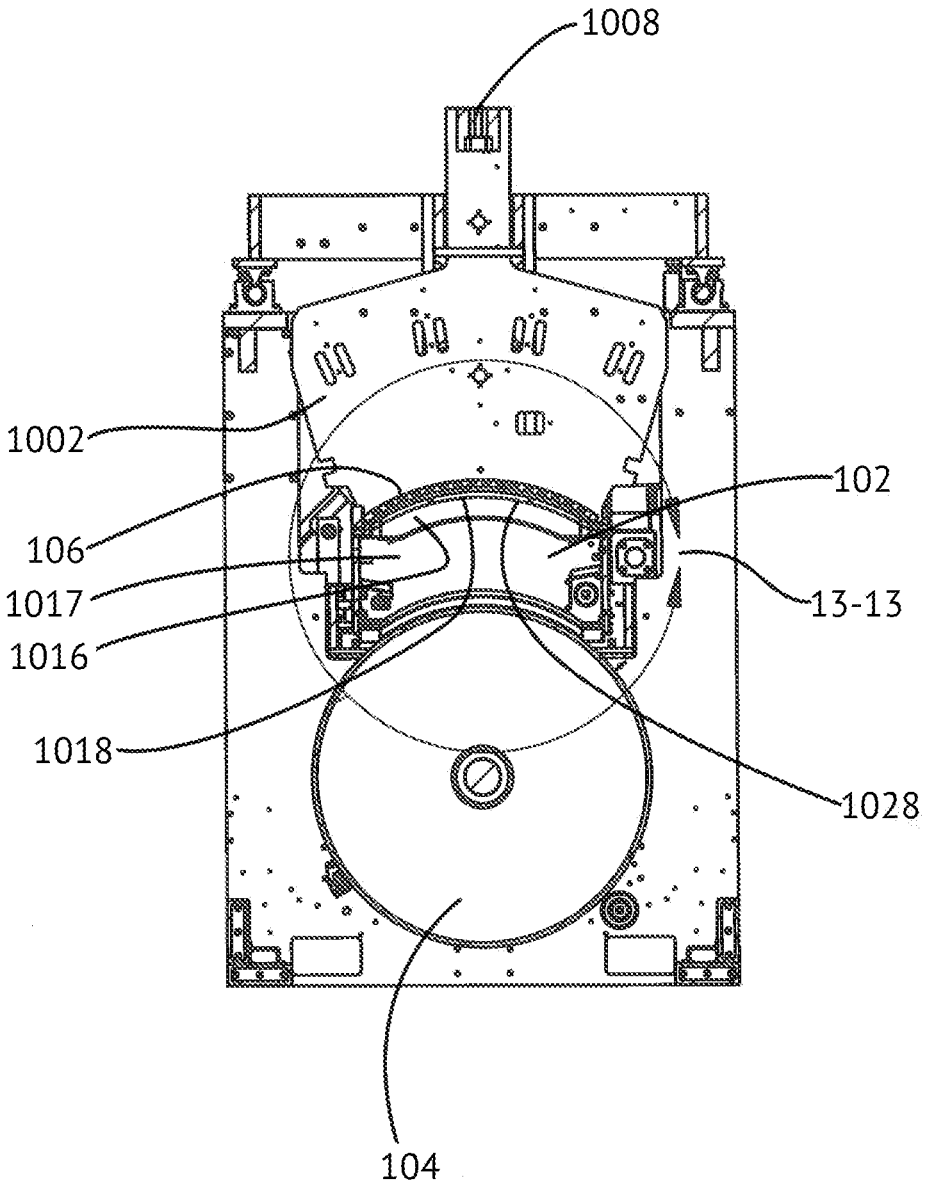
FIG. 12 is a cross-sectional view taken along the line 12-12 of the printing system of FIG. 11B.
Figure 13:
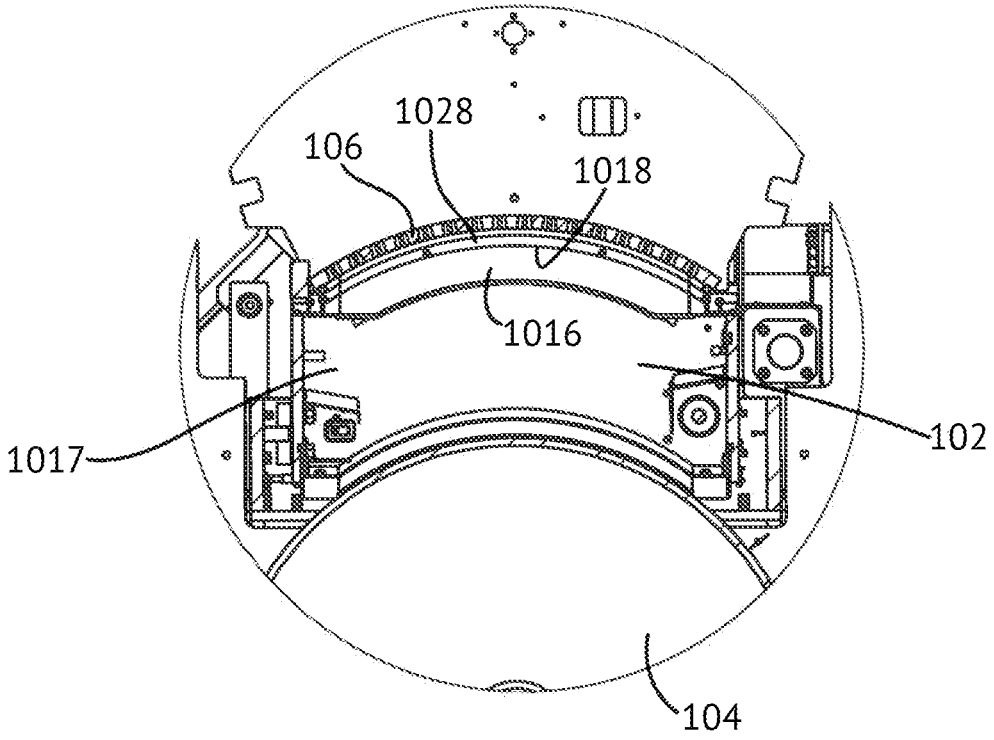
FIG. 13 is an enlarged fragmentary view of the area 13-13 of the FIG. 12.

FIG. 10 shows an embodiment printing system 10 with the carrier 106 positioned over the drum 104 for printing. The cover 700 is in the closed position to protect the components, such as the wiper units 302, of the cleaning unit 102. The carrier 106 is shown without any inkjet cartridges disposed therein for sake of simplicity. One end of the carrier 106 is secured to a plate 1002 and another end of the carrier 106 is secured to plate 1004. The plates 1002 and 1004 are secured to a lifting member 1006, which is coupled to a lifting screw 1008. The cleaning unit 102 is coupled to a drive screw operated by a motor 1014.

To initiate the cleaning process, the cover 700 is moved to the open position and the controller 114 actuates the motor 1010. Actuation of the motor 1010 rotates the lifting screw 1008 and thereby causes the lifting member 1006 to movement upward along a direction D. The upward movement of the lifting member 1006 causes the plates 1002,1004 and the carrier 106 secured to such plates to also move along the direction D and away from the drum 104. Thereafter the controller 114 actuates the motor 1014 to rotate the drive screw and transports the cleaning unit 102 in the direction E until the cleaning unit is 102 is positioned under the carrier 106. Thereafter, the controller 114 actuates the motor 1010 to move the carrier downward in a direction opposite to the direction D until the carrier 106 rests over the cleaning bay 306 of the cleaning unit 102.

FIGS. 11A-B, 12, and 13 show the carrier 106 disposed in the cleaning unit 102 as described above. In one embodiment, the cleaning unit 102 includes a wall member 1016 secured to sidewall 1017 of the cleaning unit 102. Such wall member includes an outer edge 1018 shaped to conform to the arcuate shape of the carrier 106. A similar wall member (not shown) is secured to a sidewall (not shown) opposite the wall 1017.

A wall member 1020 is secured to a sidewall 1022 of the cleaning unit 102. The wall member 1020 includes an outer edge 1024 that conforms to the side edge 1026 of the carrier 106. A similar wall member (not shown) is secured to a sidewall (not shown) opposite the sidewall 1022 of the cleaning unit 102. A continuous sealing member 1028 is disposed along the outer edges 1018 and 1024 of the wall members 1016 and 1020, respectively, and the outer edges of the wall members opposite the wall members 1016 and 1020. In one embodiment the continuous sealing member 1028 is a compressible hollow rubber tube. It should be apparent that other materials such as silicone, plastic, foam, or other compressible materials may comprise the sealing member 1028.

During the cleaning process and for storage, the controller actuates the motor along the direction opposite to the direct D until the carrier 106 compresses the sealing members 1028 thereby sealing nozzle plates of the inkjet cartridges disposed in the carrier 106 to protect the volume of space between the bottom surface the carrier 106 and the cleaning bay 306 of the cleaning unit 102 from the environment outside the cleaning unit 012. The humidity, pressure, and temperature in such volume of space may be controlled as described above.

In one embodiment, the wall members 1016 and 1020, and wall members opposite thereto are secured to carrier 106. In such embodiments, such wall members are not secured to the sidewalls of the cleaning unit 102. Rather, the sealing member 102 is secured to the top edges of the sidewalls 1017 and 1022 and sidewalls opposite thereto. During cleaning and storage, the bottom edges of the wall members 1016 and 1020 are urged downward to form a seal with the sealing member 1028. The sealing member 102 may be secured to the bottom surfaces of the wall member 1016 and 1020, and wall members opposite thereto, and not the top edges of the sidewalls 1017 and 1022, and sidewalls opposite thereto.

INDUSTRIAL APPLICABILITY

Numerous modifications to the present embodiments will be apparent to those skilled in the art in view of the foregoing description. Accordingly, this description is to be construed as illustrative only and is presented for the purpose of enabling those skilled in the art to make and use the embodiments and to teach the best mode of carrying out same.

We claim:

1. A printing system, comprising:
a plurality of inkjet cartridges disposed on a carrier;
a wiping unit, wherein the wiping unit includes a plurality of wiper blades;
a motor to effect relative movement between the carrier and the wiping unit such that the plurality of wiper blades cleans the plurality of inkjet cartridges;
a wiper wash unit actuator that causes the wiper wash unit to clean the plurality of wiper blades; and
a controller that determines when a cleaning cycle is to be undertaken, and, in response, coordinates the automatic operation of the motor.

2. The printing system of claim 1, further comprising a cleaning bay and a transport system, wherein the controller operates the transport system to position automatically the carrier over the cleaning bay.

3. The printing system of claim 2, wherein the transport system comprises a cleaning bay transport and a carrier transport, wherein the carrier transport moves the carrier in a first direction and the cleaning bay transport moves the cleaning bay in a second direction, and the second direction is perpendicular to the first direction.

4. The printing system of claim 2, further including a sealing member, wherein the sealing member substantially encloses a surface of the carrier when the carrier is positioned in the cleaning bay.

5. The printing system of claim 4, further comprising means for adjusting at least one of humidity, temperature, and ambient pressure in the cleaning bay when the surface of the carrier is substantially enclosed.

6. The printing system of claim 2, further comprising a cover wherein the cover and the cleaning bay substantially enclose the wiping unit.

7. The printing system of claim 1, wherein the wiper wash unit includes a plurality a spray nozzles, wherein the spray nozzles discharge a fluid.

8. The printing system of claim 1, wherein the carrier is arcuate.

9. A method of cleaning a plurality of inkjet cartridges disposed on a carrier, comprising the steps of:
providing a wiping unit, wherein the wiping unit comprises a plurality of wipers;
operating a controller to determine when a cleaning cycle is to be undertaken, and to effect relative movement between the wiping unit and the carrier automatically such that the wipers clean the plurality of inkjet cartridges; and
operating the controller to actuate the wiper wash unit automatically to clean the plurality of wipers.

10. The method of claim 9, comprising the further step of positioning the carrier over a cleaning bay.

11. The method of claim 10, wherein the step of positioning the carrier includes the steps of transporting the carrier in a first direction and transporting the cleaning bay in a second direction, wherein second direction is perpendicular to the firs direction.

12. The method of claim 10, comprising the further step substantially enclosing a surface of the carrier in the cleaning bay.

13. The method of claim 12, comprising the further step adjusting at least one of humidity, temperature, and ambient pressure in the cleaning bay when the carrier is enclosed in the cleaning bay.

14. The method of claim 12, comprising the step of substantially enclosing the wiping unit in the cleaning bay.

15. The method of claim 9, wherein the step of actuating the wiper wash unit includes the step of spraying a fluid to clean the plurality of wipers.

16. A printing system, comprising:

a plurality of inkjet cartridges disposed on a carrier;

a bay;

a transport system for automatically effecting relative movement between the carrier and the bay; and a sealing member for the bay, wherein when the carrier is positioned over the bay, the sealing member substantially protects a surface of the carrier from the environment outside the bay.

17. The printing system of claim 16, further comprising means for adjusting one of humidity, temperature, and ambient pressure in the bay.

18. The printing system of claim 16, wherein the transport system positions the carrier over the bay.

19. The printing system of claim 18, wherein the transport system comprises a bay transport and a carrier transport, wherein the carrier transport moves the carrier in a first direction and the bay transport moves the bay in a second direction, wherein the first direction is perpendicular to the second direction.

20. The printing system of claim 16, further comprising a wiping unit that cleans the inkjet cartridges when the carrier is positioned over the bay.

21. The printing system of claim 20, further comprising a wiper wash unit that cleans the wiping unit after the wiping unit has cleaned the inkjet cartridges.

22. A method of storing inkjet cartridges disposed on a carrier, comprising the steps of:

operating a controller to effect relative movement automatically between the carrier and a bay;

forming a seal between the carrier and the bay; and wherein the seal substantially protects a surface of the carrier from the environment outside the bay.

23. The method of claim 22, comprising the further steps of adjusting one of humidity, temperature, and ambient pressure in the bay.

24. The printing system of claim 23, comprising the further step of washing the wiping unit after the wiping unit has cleaned the inkjet cartridges.

25. The method of claim 22, wherein the step of effecting relative movement includes the step of transporting the carrier in a first direction and the step of transporting the bay in a second direction, wherein the first direction is perpendicular to the second direction.

26. The printing system of claim 22, further comprising the step of transporting a wiping unit to clean the inkjet cartridges when the carrier is positioned over the bay.

* * * * *